United States Patent [19]

Wagner

[11] Patent Number: 4,886,039

[45] Date of Patent: Dec. 12, 1989

[54] ARCHERY BOW LOCK DEVICE

[76] Inventor: John G. Wagner, Geldropsedijk 13, Nuenen 5672 AA, Netherlands

[21] Appl. No.: 46,753

[22] Filed: May 7, 1987

[51] Int. Cl.[4] ..... F41B 5/00

[52] U.S. Cl. ..... 124/23 R; 124/86; 124/DIG. 1

[58] Field of Search ..... 124/24 R, 23 R, 35 A, 124/35 R, 90, 91, 86, DIG. 1, 88

[56] References Cited

U.S. PATENT DOCUMENTS

| | | | |
|---|---|---|---|
| 4,203,412 | 5/1980 | Rickard | 124/23 R |
| 4,207,858 | 6/1980 | Blackstone | 124/23 R |
| 4,294,221 | 10/1981 | Bryant | 124/DIG. 1 X |
| 4,421,093 | 12/1983 | Stock | 124/86 |
| 4,471,747 | 9/1984 | Nishioka | 124/23 R |
| 4,612,906 | 9/1986 | Troncoso | 124/86 X |
| 4,705,015 | 11/1987 | Troncoso, Jr. | 124/24 R |
| 4,757,799 | 7/1988 | Bozek | 124/23 R |

*Primary Examiner*—Randolph A. Reese
*Assistant Examiner*—Peter M. Cuomo
*Attorney, Agent, or Firm*—Wolder, Gross & Yavner

[57] ABSTRACT

An archery bow lock mechanism allows a compound bow to be locked in the fully drawn position and released by the archer upon the application of a small amount of additional draw tension. The device utilizes a pair of pawl and ratchet members which approach each other and engage when the bow is drawn. Upon release of the drawstring the cam and ratchet members, which may be in the form of a ball and triangular ratchet, respectively, located on the bow cables, remain engaged, the ball being maintained in contact with a concave face of the ratchet by drawstring tension. Additional tension on the bow string disengages the pawl and ratchet, allowing the bow to be fired. Alternative positions for the ratchet and pawl members are available.

10 Claims, 8 Drawing Sheets

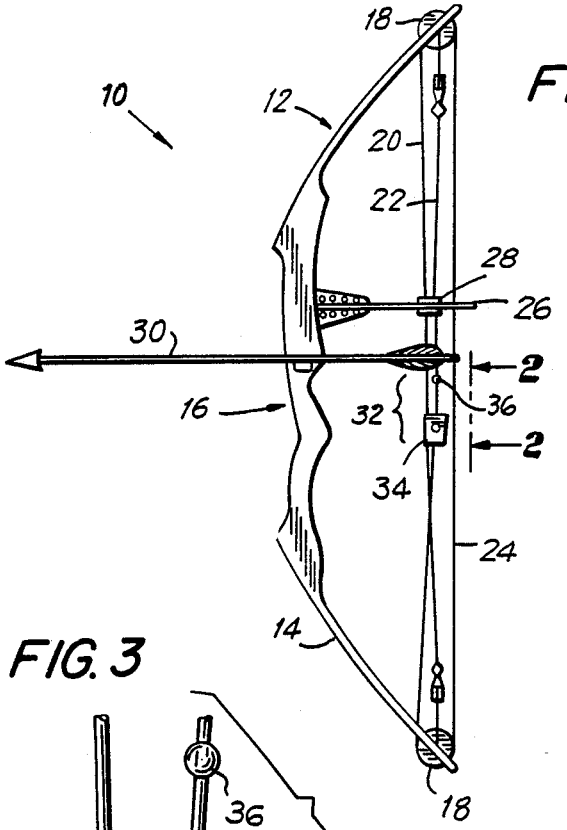
FIG. 1
FIG. 2
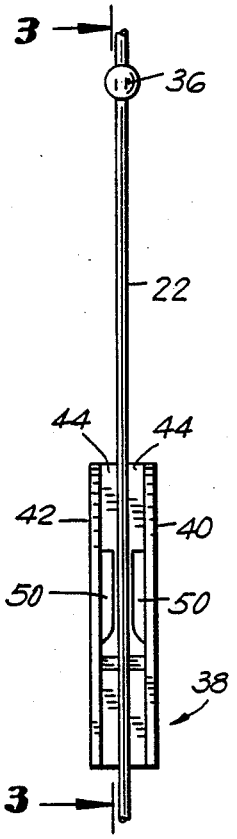
FIG. 3
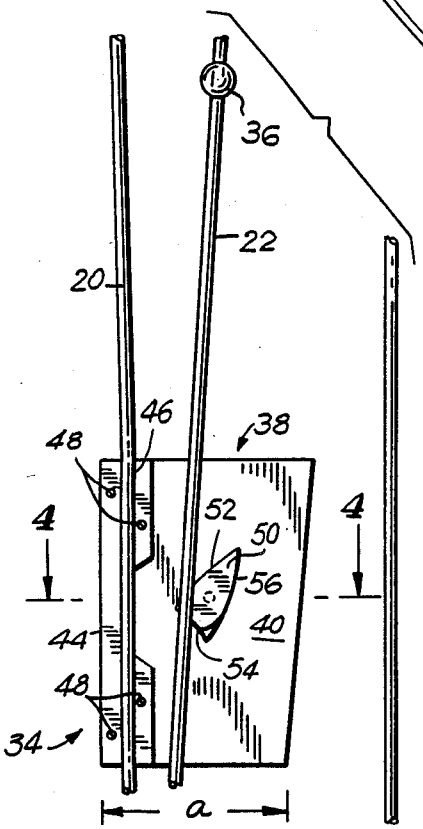

FIG. 4
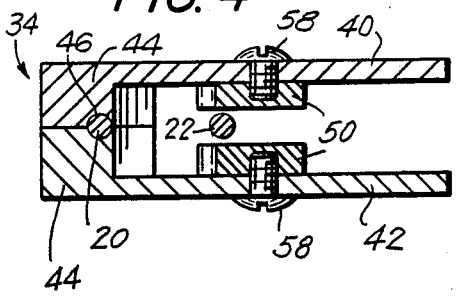
FIG. 5
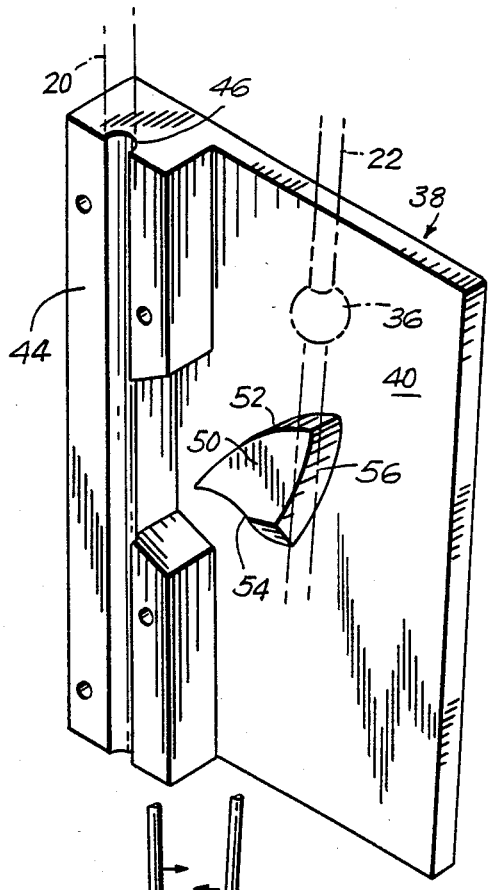
FIG. 6
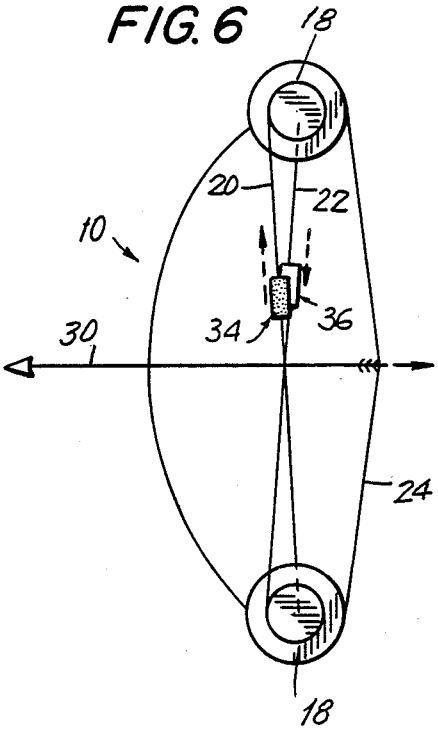
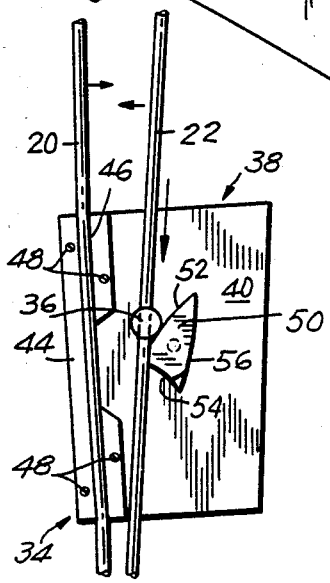
FIG. 7

ARCHERY BOW LOCK DEVICE

The present invention relates to a new and improved archery device and in particular to a bow lock designed to be utilized in conjunction with compound archery bows, such as those exemplified in U.S. Pat. No. 3,456,495 to N. W. Allen.

Modern archery bows are relatively complex devices, utilizing mechanical aids, such as pulley systems, to provide a significant degree of bow tension without the necessity of the archer possessing great strength to hold the bow in the drawn position. Through such technology archery bows have progressed to a point where they are capable of projecting an arrow with great accuracy over long distances. In addition to competitive target shooting, such bows are often used for hunting.

In many situations it is often desirable for the archer to hold the bow in its fully drawn position for an extended period of time prior to actually releasing the arrow. Rather than having the archer manually maintain tension in the bow, it is highly desirable that the archer be able to relax while the bow is maintained in its fully drawn position rather than having to continually pull on the bow string with the force which was required to initially draw it to that position.

In numerous jurisdictions, however, regulations or laws prohibit the use of a locking mechanism which permits the archer to maintain such a relaxed position and then release or discharge the arrow by purely mechanical means, as is exemplified by the common crossbow. Such regulations require that the archer manually apply tension to the bow string at the time of arrow release, such that the full draw force of the bow is directly supported and controlled by the archer at that time.

Numerous mechanisms have been designed to provide a mechanism for bow locking and subsequent manual disengagement. For example, U.S. Pat. No. 4,417,747 of Sept. 18, 1934 to Nishioka discloses an archery bow in which a series of rotating cams both preload the bow and maintain the bow in a loaded configuration. Such prior art, as exemplified by the Nishioka patent, typically utilize relatively complex mechanisms for achieving bow lock, often require specially adapted or designed bows and permit the archer to mechanically discharge the arrow.

It is accordingly a purpose of the present application to provide a bow lock apparatus which can lock a compound bow in the drawn position whereby additional draw by the archer is necessary to release the bow lock. A further purpose of the present invention is to provide bow locking apparatus which may be utilized in conjunction with conventional compound bows. Yet a further purpose of the present invention is to provide such a locking apparatus which is economical to manufacture, easy to install, and simple to operate without deviation from the normal characteristics of the bow.

In furtherance of the above and other purposes, the bow locking device of the present invention comprises interlocking pawl and ratchet means mounted to a compound bow such that the pawl and/or ratchet are moveable with respect to each other as the bow is drawn. The ratchet means are adapted and arranged to engage and retain the pawl as the bow is drawn to a cocked position and tension on the drawstring released, thus immobilizing the drawstring cables and maintaining the bow in the cocked position. The ratchet means is further designed that as full tension is re-applied to the bow string the pawl disengages from the ratchet and is permitted to return to its undrawn position when the bow is fired. Until such tension is re-applied the bow is maintained and locked in the cocked position. The pawl and ratchet means can be located in a variety of positions, including on the drawstring cables, on a cable spacer, or on the bow tips and pulleys.

A greater understanding of the present invention will be accomplished upon consideration of the following detailed description of preferred but nonetheless illustrative embodiments of the invention when taken in conjunction with the annexed drawings wherein:

FIG. 1 is an elevation view of a compound bow incorporating a first embodiment of the present invention;

FIG. 2 a partial elevation view taken along line 2—2 of FIG. 1 illustrating the pawl and ratchet of that embodiment;

FIG. 3 is a partial elevation view taken along line 3—3 of FIG. 2 further detailing the arrangement of the pawl and ratchet;

FIG. 4 is a partial actional view taken along line 4—4 of FIG. 3;

FIG. 5 is a perspective view of the interior portion of the ratchet mechanism;

FIG. 6 is a schematic representation of the travel of the pawl and ratchet of the first embodiment as tension is applied to the bow;

FIG. 7 is an interior view of the ratchet housing of the embodiment as the pawl engages the ratchet mechanism as shown schematically in FIG. 6;

Figure 8:
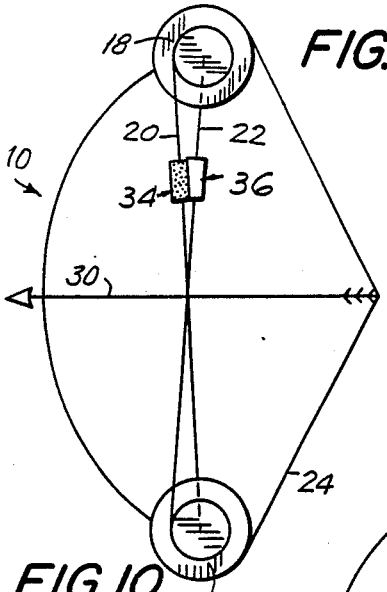
FIG. 8 is a schematic representation of the bow mechanism of the first embodiment in the locked position.

Referring initially to FIGS. 1-13 which detail a first preferred embodiment, compound archery bow 10 comprises flexible bow limbs 12 and 14 joined by central hand grip or handle section 16. Each bow limb is provided with a means for increasing the mechanical advantage of the archer, such as a cam or a rotating eccentric wheel 18 at the limb tip. First and second cables 20, 22 respectively are each affixed to a bow tip, ride on the eccentric wheel 18 of the opposite bow tip, and terminate opposite ends of bow string 24. A cable clearance bar 26 with moveable slider 28 may be mounted as known in the art to handle section 16 to prevent cables 20, 22 from tangling with themselves or interfering with arrow 30 or bowstring 24 as the bow is drawn and arrow 30, nocked in bow string 24, is released. Locking mechanism 32, as will be further detailed and explained, comprises a ratchet means 34 mounted on first cable 20 and a pawl means 36 mounted on second cable 22.

Referring next to FIGS. 2, 3, and 4, ratchet means 34 comprises a ratchet housing 38 formed of a pair of spaced parallel plates 40, 42 each having an inwardly directed shoulder 44 along its forward vertical edge. Each shoulder 44 may be provided with a groove or track 46 along its length such that cable 20 may be grasped securely therein, firmly affixing the ratchet housing to cable 20 when plates 40, 42 are aligned on the cable and secured together by screws or other means in appropriately dimensioned complementary bores 48.

The shoulders 44 are of combined thickness sufficient to permit second cable 22 and affixed pawl means 36 to pass therebetween. The plates 40, 42 are so dimensioned in the horizontal (as shown by the distance "a" in FIG. 3) as to insure that second cable 22 is retained between the plates as the bow is drawn. Slider 28 may be used to control cable spacing as required by the size of the plates.

Mounted on the inner face of each of plates 40, 42 is a generally triangularly-shaped ratchet tooth 50. Each ratchet tooth 50 has a mildly convex, inclined first face 52, abutting at its lower extremity second, concavely curved pawl retaining face 54. The third peripheral surface of ratchet tooth 50 is mildly convex face 56, which joins the lower end of second face 54 and the upper end of first face 52. As previously indicated, the thickness of shoulders 44 are so dimensioned that pawl means 36, which may comprise a ball rigidly affixed to second cable 22, may pass between plates 40, 42. The thickness of ratchet teeth 50, as shown in FIG. 2, is such that a channel is defined between the ratchet teeth bodies allowing second cable 22 to pass therebetween, while pawl ball 36 will contact and accordingly be deflected to ride along the faces thereof. Teeth 50 are located in the path of ball 36 as the bow is drawn to insure such contact, and may be provided with inclined surfaces at the face vertices to insure smooth contact between the ratchet, pawl and second cable. As may be seen in FIG. 4, ratchet teeth 50 may be mounted to plates 40, 42 by means of appropriately dimensioned screws 58.

Figure 9:
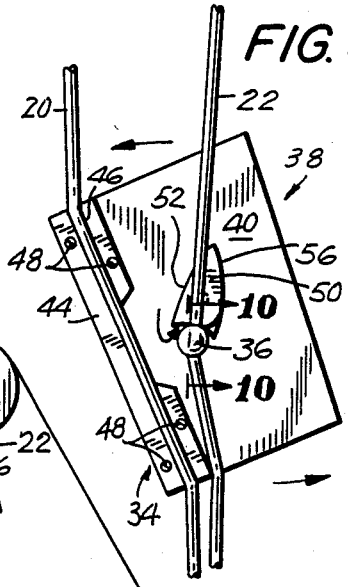
FIG. 9 is an interior view of the ratchet housing showing the pawl and ratchet in the locked position as shown schematically in FIG. 8.
Figure 10:
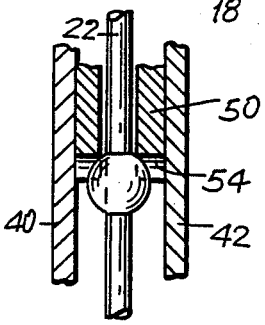
FIG. 10 is a sectional view taken along line 10—10 of FIG. 9 further showing the interlock of the pawl and ratchet.

As seen in FIG. 1, ratchet and pawl means 34, 36 are mounted to cables 20, 22 respectively such that they are separated when the bow is in the undrawn position but pass each other as the bow is drawn. As the bow is drawn, as depicted schematically in FIG. 6, the ratchet and pawl means approach each other, as the distance between the bow tips to which the adjusted cables are fastened decreases. The angle of approach can be adjusted within a small range by the spacing of the cables by slider 28. As seen in FIGS. 5 and 7, the portion of cable 22 bearing pawl ball 36 passes between ratchet housing plates 40, 42. As ball 36 passes between the plates it contacts first ratchet teeth faces 52. This contact deflects both the ball and cable 22, as well as ratchet 34 and cable 20 from their normal paths. Ball 36 rides down first ratchet teeth faces 52 until it reaches second pawl-retaining faces 54, as shown in FIG. 9. At that point, which may be sensed by the archer due to the change in direction of the ball over the vertex between the first and second faces, ball 36 will be retained by the concave nature of the second teeth faces if tension on the drawstring is released, since the natural restoring force of cables 20 and 22 is into the faces. At that point the archer may fully release draw on the draw string, tension in the bow being maintained by the immobility of cables 20, 22 by virtue of the retaining of pawl ball 32 by ratchet teeth 50. When entering the locked position ratchet means 34 may rotate as indicated by the arrows in FIG. 9, to accommodate the locking forces upon it. The bow can now not be fired until full tension is again applied to the bowstring.

Figure 11:
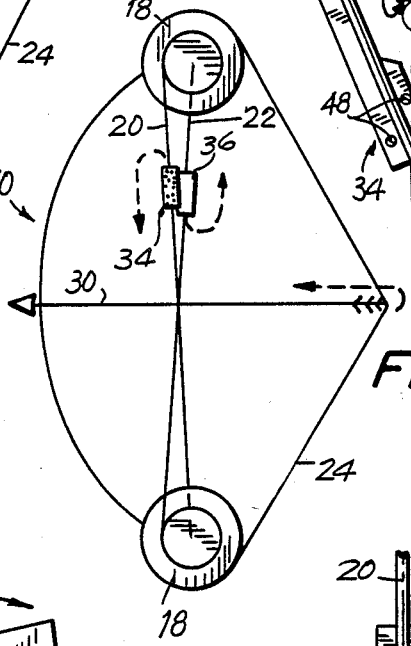
FIG. 11 is a schematic representation of the bow as the pawl and ratchet are being disengaged by the application of further tension on the bow string.
Figure 12:
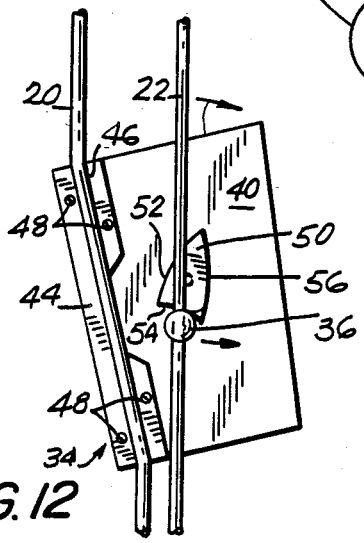
FIG. 12 is an interior view of the ratchet housing showing release of the pawl by the ratchet as shown schematically in FIG. 11.

When the archer desires to fire the arrow full tension is restored upon bow string 24, as depicted in FIG. 11. As full tension is reapplied ball 36 passes over the vertex between second pawl-retaining faces 54 and third faces 56 of ratchet teeth 50, as depicted as FIG. 12, and becomes released from the ratchet teeth. Cable 22, no longer restrained in a deflected configuration, returns to its normal orientation. At the same time, ratchet means 34 may again rotate, returning to its normal orientation.

Figure 13:
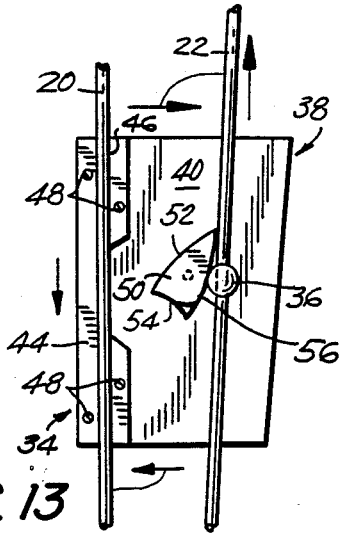
FIG. 13 is an interior view of the ratchet housing showing return of the bow to the undrawn position.

Once pawl ball 36 clears the vertex between the pawl-retaining and third faces of the ratchet teeth, release of the bow string by the archer permits the bow limbs to return from their flexed position, whereby ball 36 travels upwardly, as shown in FIG. 13, guided by third ratchet faces 56 past the descending ratchet teeth 50, whereby the bow is returned to the undrawn position. While the embodiment shown in FIGS. 1-13 illustrates the locking action in the plane of the bow it is apparent that such locking can occur in other vertical or inclined planes by suitably orienting the ratchet means 34 upon cable 22.

FIGS. 14-19 disclose a second preferred embodiment of the invention in which each cable 20,22 is provided with an individual pawl means, both of which engage with a corresponding ratchet means mounted directly to the bow.

Figure 15:
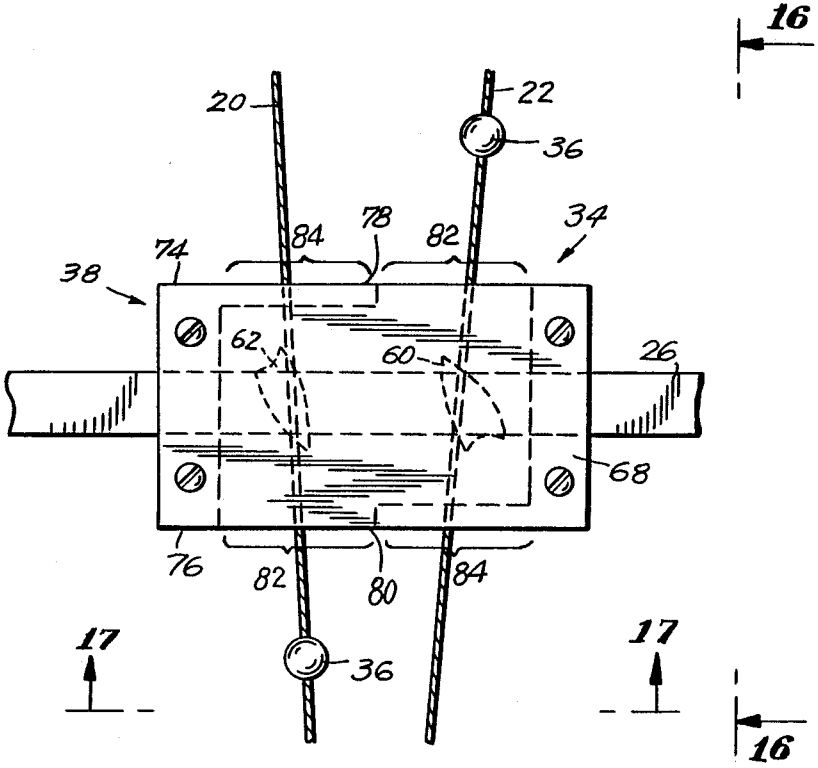
FIG. 15 is a side elevation view of the ratchet means of the second embodiment.
Figure 14:
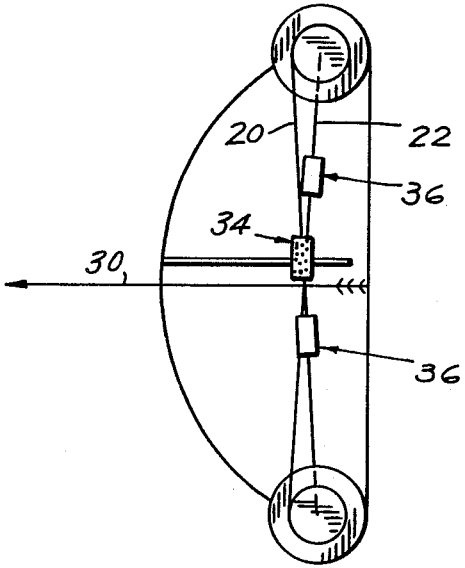
FIG. 14 is a schematic representation of a second embodiment of the present invention wherein dual pawl and ratchet means are employed.

As seen schematically in FIG. 14 and presented more clearly in FIG. 15, cables 20,22 each bear a pawl ball 36. Ratchet means 34 is mounted on cable clearance bar 26 which is firmly affixed to the bow proximate the handle section 16 and extends back past the cables 20,22 parallel to the plane of the bow and cables. Mounted within ratchet housing 38 are dual ratchet teeth pairs 60,62, each of which pair is mounted within the ratchet housing 38 so as to deflect and retain one of the pawl balls 36 on cables 20 and 22.

Figure 16:
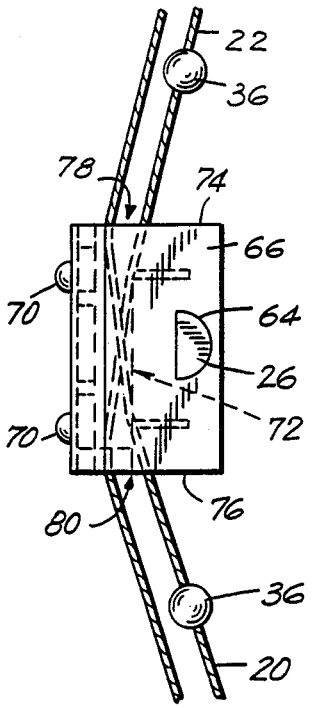
FIG. 16 is an end elevation view of the ratchet means taken along line 16—16 of FIG. 15.
Figure 17:
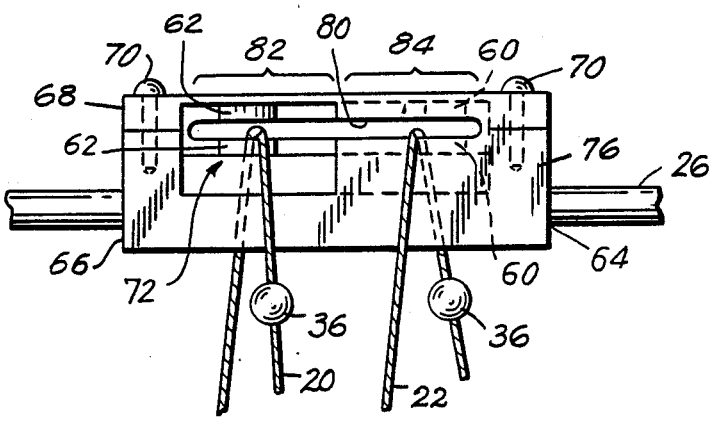
FIG. 17 is a bottom plan view of the ratchet means taken along line 17—17 of FIG. 15.

As may be seen in FIGS. 16 and 17, ratchet housing 38 is provided with a D-shaped slot 64 through which clearance bar 26 projects. This slot allows the ratchet housing 38 to slide along clearance bar 26 while maintaining the housing 38 in proper orientation with respect to the cables 20,22. Housing 38 may be comprised of plates 66 and 68, the interior and abutting faces of which are provided with appropriate channel-ways through which the cables 20,22 can pass, the surfaces of which ratchet teeth pairs 60 and 62 are mounted. The plates 66 and 68, when affixed together such as by screws 70, are constructed to define a central aperture 72 through which the cables 20,22 pass. This aperture is offset from the plane of the bow and cables and accordingly deflects the cables outward, as shown in FIG. 16, from their normal plane of travel.

The aperture 72 may terminate on opposed top and bottom housing surfaces, 74,76 in a pair of combination entrance/exit means 78,80 each includes an entranceway portion 82 of a width sufficient to receive a respective pawl ball 36 on one of cables 20,22 and an exitway portion 84 of a reduced width through which the other of cables 20,22, but not the respective pawl ball 36, can exit. The apertures serve a cable spacer function and accordingly define the approach angles for the ratchet and pawl, and in addition prevent the operator from overdrawing the bow.

As in the first embodiment each of the ratchet teeth of pairs 60 and 62 contain first, second and third faces 52,54, 56 respectively which allow the pawl balls 36 to be retained by the concave nature of the second faces 54 as the bow is drawn. The ratchet teeth pairs, 60,62 are located within the aperture 72 as required by the path of the cables 20,22 to insure that ratchet-pawl contact and subsequent release is achieved as the bow is drawn.

Figure 19:
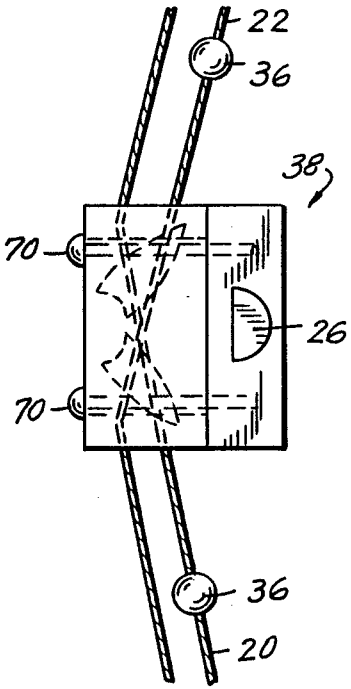
FIG. 19 is an end elevation view of the ratchet means of FIG. 18 taken along line 19—19.
Figure 18:
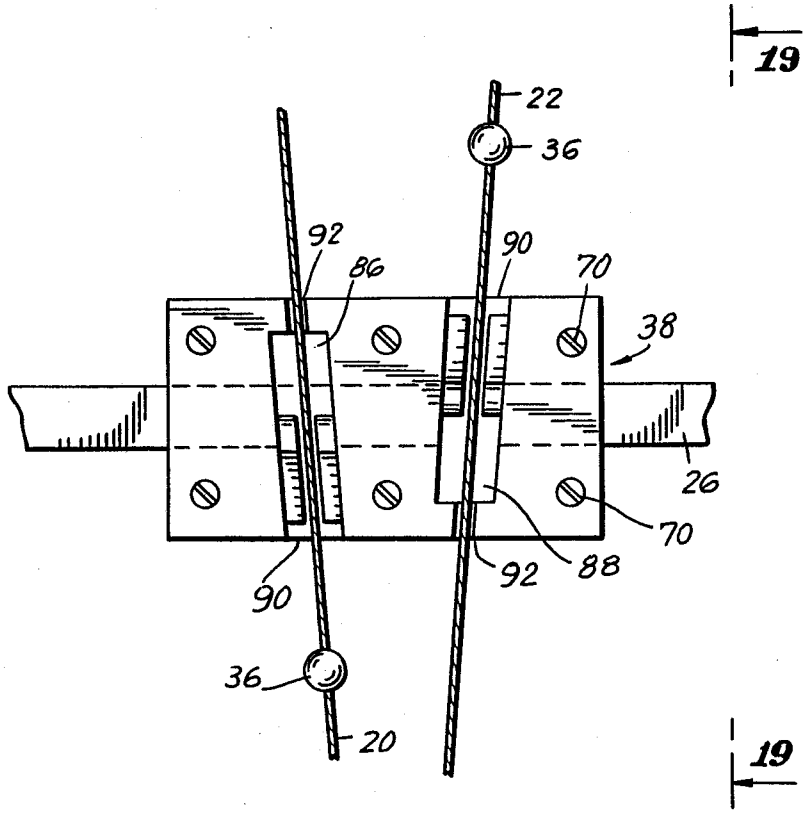
FIG. 18 is a side elevation view of the ratchet means of the second embodiment illustrating an alternative orientation of the ratchet means.

As shown in FIGS. 18 and 19, ratchet teeth pairs 60 and 62 may be mounted in a sense perpendicular to that of the plane of the bow and cables such that the cables are further deflected out of their normal plane by the contact of the pawls 36 with the respective ratchet teeth. In this embodiment the teeth pairs 60, 62 are located in individual apertures 86, 88 each of which includes an entranceway 90 sufficient to pass the pawl ball 36 and an exitway 92 of reduced diameter such that the cables and pawl balls are guided into a proper angle of approach with respect to the ratchet teeth. Once again, the ratchet housing 38 is slidably mounted on cable clearance bar 26 to allow its position to conform to cable position as the bow is drawn while the ratchet teeth pair are oriented to engage and release the pawl balls as the bow is drawn.

Figure 20:
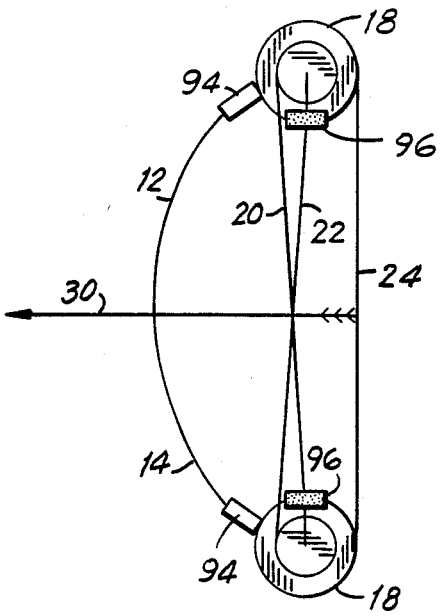
FIG. 20 is a schematic representation of a third embodiment of the present invention wherein the ratchet and pawl means are located at the bow tips.

A third preferred embodiment of the present invention is detailed in FIGS. 20–24. In this embodiment, as illustrated in the schematic of FIG. 20, the pawl means 94 are located on the limbs 12, 14 of the bow, while the ratchet means 96 are formed as part of the eccentric wheels 18.

Figure 22:
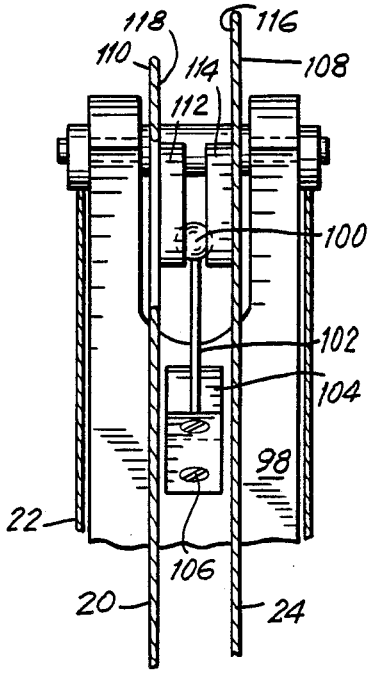
FIG. 22 is an end elevation view taken along line 22—22 in FIG. 21.
Figure 21:
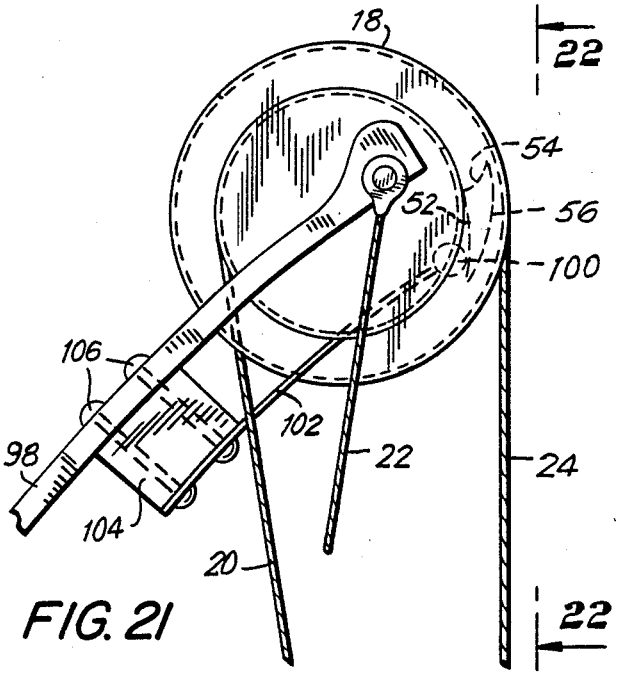
FIG. 21 is a side elevation view of a bow tip detailing the ratchet and pawl means of the third embodiment.

As may be seen in FIGS. 21 and 22, each bow limb tip 98 is provided with spherical pawl element 100 on resilient stalk 102 mounted to the limb tip by mounting block 104. A pair of rivets or screws 106 may be utilized to mount the stalk 102 to the block 104 and to the limb tip 98. Eccentric wheel 18, which includes parallel peripheral tracks 108 and 110, is provided with dual ratchet teeth 112, 114 each having three faces formed as in the other embodiments. Ratchet teeth 112, 114 are mounted on opposed inner faces 116, 118 of tracks 108, 110 such that, as eccentric wheel 18 rotates clockwise in FIG. 21 as bow string 24 is drawn, pawl element 100 rides on first face surfaces 52, deflecting stalk 102, and may be retained by second, pawl-retaining faces 54, as stalk 102 attempts to return to its normal position. As in the other embodiments, tension re-applied to the bow string after the pawl element 100 is retained by face 54 disengages the pawl ball from face 54, and allows stalk 102 to fully return to its normal unflexed position wherein, when the bow string is released, pawl ball element 106 passes to the outside of the ratchet teeth, past third faces 56.

Figure 24:
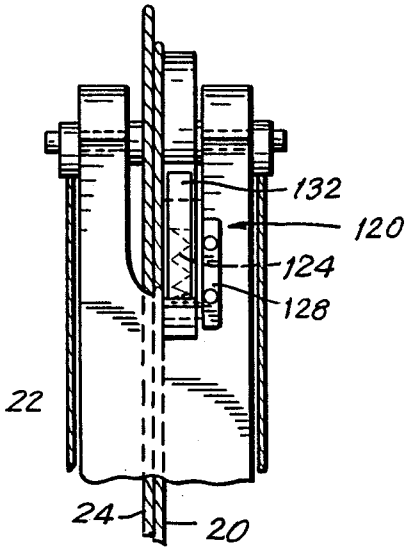
FIG. 24 is an end elevation view of the alternative pawl and ratchet configuration taken along line 24—24 in FIG. 23.
Figure 23:
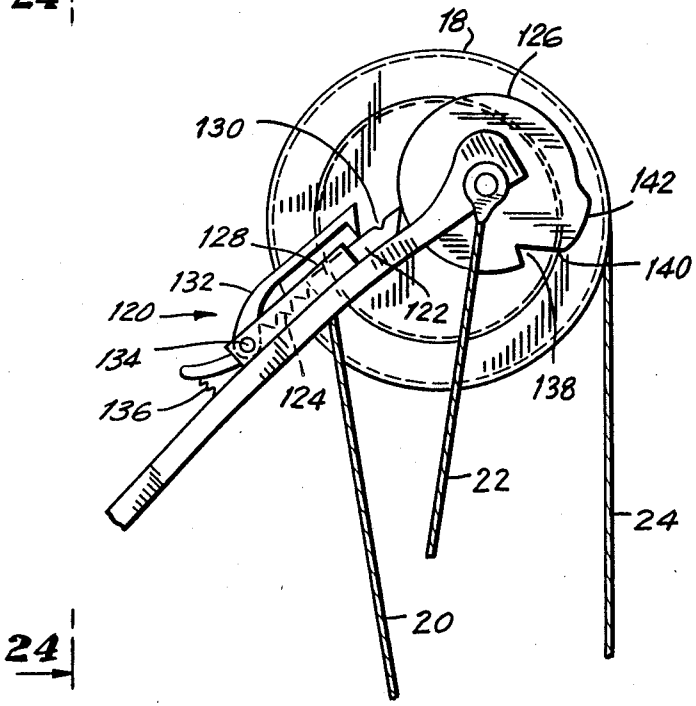
FIG. 23 is a side elevation view of an alternative pawl and ratchet configuration of the third embodiment.

In yet another alternative embodiment, the ratchet and pawl mechanism of the present invention may be mounted to the limb tips and eccentric wheels in a manner which allows selective utilization of the locking feature. As shown in FIGS. 23 and 24, in this embodiment pawl means 120 comprises a first spring loaded arm 122 biased by spring 124 into continuous contact with ratchet means cam wheel 126 mounted coaxially with the eccentric wheel 18. The arm 122 is slide mounted within housing 128 mounted on the bow tip and is provided with a notch 130 on its upper surface into which locking arm 132, which pivots about rod 134 in housing 128, is urged by spring 136 as arm 122 is retracted by operation of cam 126.

Cam 126 is provided with notch 138 located at a point such that it is engaged by spring loaded arm 122 when bow string 24 is in the fully drawn position. Notch surface 140 which leads into raised cam portion 142 is so oriented and shaped to allow spring loaded arm 122 to be withdrawn into housing 128 as the bow is further drawn. This causes locking arm 132 to engage with locking notch 130 on spring loaded arm 122. Once the notch is so engaged spring loaded arm 122 remains in the fully withdrawn position, thus allowing cam 126 and eccentric wheel 18 to return unimpeded to the start position when the bowstring is released as the bow is fired. As arm 122 remains withdrawn, this embodiment has the additional feature that the archer can either reset the locking mechanism by disengaging locking arm 132 from arm 122 or keep the mechanism inactive by maintaining engagement.

The foregoing embodiments are illustrative of the present invention and are not intended to limit the scope thereof. For example, it will be apparent to one skilled in the art that the relative positioning of pawl and ratchet elements may be interchanged or varied within the scope of the invention. Accordingly, the true scope of the present invention is to be measured by the claims in light of the specification hereof.

I claim:

1. A bow locking apparatus for use in conjunction with a compound archery bow having first and second cables connected to opposite ends of a draw string supported by and extending between opposite ends of bow limbs joined by a rigid hand grip, comprising interlocking pawl and ratchet means mounted to said bow, at least one of said pawl and ratchet being movable with respect to the other, at least one of said pawl and ratchet means being affixed to at least one of said first and second cables for movement therewith, said ratchet means being adapted and arranged to engage and retain said pawl as the bow is drawn to a cocked position from the undrawn position whereby said first and second cables are immobilized to maintain said bow in the cocked position and to disengage said pawl for unrestricted cable return motion to the undrawn position when the bow is fired only as said bow is further drawn beyond said cocked position.

2. The apparatus of claim 1 wherein said pawl means is mounted to said first cable and said ratchet is mounted to said second cable.

3. The apparatus of claim 2 wherein said ratchet means comprises a ratchet housing mounted to said second cable having first cable entry and exit means therethrough and supporting ratchet tooth means therein, said ratchet tooth means having a first face for deflecting said pawl along said first face to a second face, said second face adapted for retaining said pawl in contact therewith when said bow is in the cocked position, and a third face for directing said pawl through said ratchet housing past said first and second faces when said bow is fired.

4. The apparatus of claim 3 wherein said ratchet tooth means comprises a pair of ratchet teeth, each of said teeth having said first, second and third faces arranged in a triangular configuration.

5. The apparatus of claim 1 wherein said pawl means comprises first and second pawls mounted to said first and second cables, respectively, and said ratchet means is mounted on bracket means extending towards said cables from proximate said hand grip.

6. The apparatus of claim 5 wherein said ratchet is slideably mounted to said bracket means.

7. The apparatus of claim 5 wherein said pawl and ratchet means deflect said first and second cables within a plane approximating the plane of said bow upon engagement of said pawl by said ratchet means.

8. The apparatus of claim 5 wherein said pawl and ratchet deflect said first and second cables out of the plane of said bow upon engagement of said pawl means by said ratchet means.

9. The apparatus of claim 8, wherein said ratchet means comprises a ratchet housing having first and second cable entry and exit means therethrough and supporting first and second pair of oppositely deposed ratchet teeth therein, each of said ratchet teeth pair having first faces for deflecting a pawl means on one of said first and second cables along said first face two to a second face, said second face adapted for retaining said pawl means in contact therewith when said bow is in the cocked position and a third face for directing said pawl back through said ratchet housing past said first and second faces when said bow is fired.

10. The apparatus of claim 9, wherein said first and second cable entry and exit means are each defined by a separate channel through said ratchet housing, said cable entry means portions of said channels being of a size adapted to permit entry of said pawl means therethrough while said exit means portions are adapted and sized to guide passage of said cables and thereby guide said pawl means into contact with said ratchet teeth pair.

* * * * *